US010661106B2

(12) United States Patent
Choate et al.

(10) Patent No.: US 10,661,106 B2
(45) Date of Patent: May 26, 2020

(54) RETRACTABLE LANYARD LOCK MECHANISM

(71) Applicant: Reliance Industries, LLC, Wheat Ridge, CO (US)

(72) Inventors: Gary E. Choate, Lakewood, CO (US); Dan Henn, Spring Branch, TX (US)

(73) Assignee: RELIANCE INDUSTRIES, LLC, Wheat Ridge, CO (US)

( * ) Notice: Subject to any disclaimer, the term of this patent is extended or adjusted under 35 U.S.C. 154(b) by 31 days.

(21) Appl. No.: 16/002,563

(22) Filed: Jun. 7, 2018

(65) Prior Publication Data

US 2018/0280740 A1 Oct. 4, 2018

Related U.S. Application Data

(62) Division of application No. 15/165,781, filed on May 26, 2016, now Pat. No. 10,004,927.

(60) Provisional application No. 62/168,106, filed on May 29, 2015.

(51) Int. Cl.
*A62B 35/00* (2006.01)

(52) U.S. Cl.
CPC ..... *A62B 35/0093* (2013.01); *A62B 35/0043* (2013.01)

(58) Field of Classification Search
CPC ..... A62B 35/0043; A62B 35/0093
See application file for complete search history.

(56) References Cited

U.S. PATENT DOCUMENTS

| | | | |
|---|---|---|---|
| 3,150,744 | A | 9/1964 | Fertier |
| 3,760,910 | A | 9/1973 | Koshihara |
| 4,511,123 | A | 4/1985 | Ostrobrod |
| 4,589,523 | A | 5/1986 | Olson et al. |
| 4,877,110 | A | 10/1989 | Wolner |
| 5,351,908 | A | 10/1994 | Umezawa et al. |
| 5,771,993 | A | 6/1998 | Anderson et al. |
| 5,829,548 | A | 11/1998 | Ostrobrod |
| 6,224,008 | B1 | 5/2001 | Smithson et al. |
| 6,279,682 | B1 | 8/2001 | Feathers |
| 6,598,822 | B2 | 7/2003 | Nagata et al. |
| 6,810,997 | B2 | 11/2004 | Schreiber et al. |
| 7,083,135 | B2 | 8/2006 | Fleischmann et al. |
| 7,210,645 | B2 | 5/2007 | Paterson et al. |
| 7,281,620 | B2 | 10/2007 | Wolner et al. |
| 7,857,099 | B2 | 12/2010 | Choate |
| 7,870,934 | B2 | 1/2011 | Ecker |
| 7,946,387 | B2 | 5/2011 | Betcher et al. |
| 8,226,024 | B2 | 7/2012 | Meillet |
| 8,251,176 | B2 | 8/2012 | Meillet et al. |
| 8,469,149 | B2 | 6/2013 | Meillet et al. |
| 8,528,694 | B2 | 9/2013 | Meillet et al. |
| 2010/0224448 | A1 | 9/2010 | Wolner et al. |
| 2010/0226748 | A1 | 9/2010 | Wolner et al. |

(Continued)

FOREIGN PATENT DOCUMENTS

EP 2405975 B1 8/2013

*Primary Examiner* — Sang K Kim
(74) *Attorney, Agent, or Firm* — Sandberg Phoenix & von Gontard, P.C.

(57) ABSTRACT

A housing for the retractable is made from a lightweight, non-structural material, such as, plastic. The housing includes an internal reinforcement configured to bear the forces in a fall, thereby allowing the housing to be made from lightweight, non-structural materials.

18 Claims, 5 Drawing Sheets

(56) References Cited

U.S. PATENT DOCUMENTS

| | | | | |
|---|---|---|---|---|
| 2011/0084157 | A1 | 4/2011 | Meillet | |
| 2011/0084158 | A1 | 4/2011 | Meillet et al. | |
| 2011/0240403 | A1 | 10/2011 | Meillet | |
| 2011/0278095 | A1* | 11/2011 | Hetrich | A62B 1/10 182/231 |
| 2011/0297778 | A1 | 12/2011 | Meillet et al. | |
| 2013/0091690 | A1 | 4/2013 | Stephenson et al. | |
| 2013/0105247 | A1* | 5/2013 | Casebolt | A62B 1/10 182/241 |
| 2013/0256441 | A1 | 10/2013 | Meillet et al. | |
| 2014/0151155 | A1 | 6/2014 | Choate | |

* cited by examiner

RETRACTABLE LANYARD LOCK MECHANISM

CROSS REFERENCE TO RELATED APPLICATIONS

This application is a divisional application of application Ser. No. 15/165,781 filed May 26, 2016, which in turn, claims priority to U.S. App. No. 62/168,106 filed May 29, 2015, entitled "Retractable Lanyard Lock Mechanism." In addition, this application is related to application Ser. No. 14/094,422 filed Dec. 2, 2013 which claims priority to U.S. App. No. 61/738,981 filed Dec. 18, 2012, and U.S. App. No. 61/732,400 filed Dec. 2, 2012. All of said applications are incorporated herein by reference.

STATEMENT REGARDING FEDERALLY SPONSORED RESEARCH OR DEVELOPMENT

Not applicable.

BACKGROUND OF THE INVENTION

This invention relates generally to retractable lanyards, and more particularly to a mechanical clutch locking mechanism for a retractable lanyard that is configured to further ensure that the fall arrest lanyard will not fail to lock in a fall situation even if the locking components become fouled or frozen in place. In addition, the invention relates to a housing for the retractable lanyard.

Self-retracting lanyards (retractables) are safety devices that are designed to reduce the risks of a fall for an individual who is working at what would otherwise be dangerous or deadly heights. Each retractable comprises a cable, known as a lifeline, that is held in the retractable on a reel or drum. When the lifeline is pulled from the retractable at a relatively slow rate, such as when the user is moving about but not falling, the retractable clutch lock mechanism allows the reel or drum to rotate to unwind and the lifeline to extend from the retractable housing. However, when the lifeline is pulled from the retractable at a very rapid rate such as when a user is falling, a clutch or shock absorber or other similar clutch lock mechanism in, or associated with, the retractable reel or drum will automatically engage and slow and/or stop the reel or drum from rotating to slow or stop the unwinding of the lifeline. This halts the individual's fall after only a very brief interval.

One such retractable has an internal clutch system in which a pawl plate has a stack of friction discs on each side of a clutch plate to which the drum is connected and which can apply up to approximately 3000 pounds per square inch of compressive force to each side of the plate. This creates normal forces on friction pads that can slip under load, thus softly stopping the release of the lifeline.

Lock mechanisms for retractables also can be made in which the mechanisms that sense a fall has occurred can be activated either by sensing displacement, velocity, or acceleration. Most retractable lanyards lock up using the principal of a pivoting pawl which moves upon rotation of the drum to engage a locking wheel (commonly referred to as a sperrad) that is connected to the clutch plate.

In locking mechanisms that use "displacement," a rotating cam engages the pawl. As the drum rotates, the cam raises and lowers the pawl into an engagement zone with the sperrad. If the drum turns fast enough (as in a fall), the cam will rotate so quickly that it will cause the pawl to leave the cam surface and rise sufficiently to engage a stationary sperrad. This stops the rotation of the drum, and causes the clutch plate to begin rotating between the friction disks, allowing for a slow deceleration and eventual stopping of the decent of the falling worker. Clutch lock mechanisms are usually designed to limit the arrest forces to 900 lbs. average (or less).

In locking mechanisms that use "velocity" to determine pawl activation, the pawl is pivotally mounted on the drum. The pawl will have a pointed end and possibly a counterweighted end. The counterweighted end may be lighter or heavier than the pointed end depending on whether the pawl swings outwardly or inwardly to engage the sperrad. The pawl is restrained from engagement with the sperrad at low rotational speed of the drum by use of a spring which keeps the pointed end of the pawl out of the sperrad's engagement zone until the drum has reached a fall arrest velocity. When that rotational velocity is reached, the pawl will swing out into the engagement zone and engage the tip of the sperrad to create lockup, and thus stop rotation of the drum.

In most retractables, when a pawl is driven using velocity (i.e., "centrifugal forces") to engage a sperrad, under certain circumstances the pawl may not engage the sperrad, such as if the pawl is fowled with debris, or frozen (either due to ice or thermal contraction). This results in a situation in which the lanyard locking components may become frozen in a non-engaging position that can allow the lifeline to freely unwind from the lanyard drum without stopping. Should a user be attached to a lanyard in this condition and fall, the lifeline may continue to discharge to its full length, thereby causing serious injury or even death to the user. This condition can occur regardless of whether the lockup mechanisms use displacement, velocity, or acceleration to activate the pawl. It is only possible to substantially guarantee lockup between the pawl and the sperrad in mechanisms that use displacement (i.e., cam driven pawls) to drive the pawl tip into an engagement zone that is beyond the sperrad tip diameter. The spring then is used to pull the pawl tip out of the engagement zone just prior to passing the sperrad tip. This mechanism of using a cam driven pawl in which the cam pushes the pawl tip into an engagement zone creates a pawl mechanism in which nearly any failure of pawl rotational freedom guarantees lockup.

SUMMARY

Briefly stated, a housing for a retractable lifeline assembly comprises a first half and a second half which, in combination, define a drum receiving space for rotatably receiving a drum having a lifeline secured to and wound thereon. The housing defines a nozzle through which the lifeline can extend and retract and an attachment zone for connection of an anchor to the housing. The housing includes a reinforcement comprising opposed side reinforcing members, an upper reinforcement and a lower reinforcement. The side reinforcing members extend around an inner surface of the drum receiving space from the nozzle to the attachment zone; the lower reinforcement surrounds the nozzle and connects bottom ends of the side reinforcing members; and the upper reinforcement connects upper ends of the side reinforcing members together and defines a passage through which a shaft of the anchor extends. The anchor further includes a stop at a bottom of the shaft sized to prevent the shaft from being pulled from the housing. The reinforcement is made from a structural material, whereby, during a fall, if the first half or the second half of the housing should suffer a structural integrity failure that would otherwise allow the anchor to wholly separate from the housing, the reinforcement will contain the drum and attached lifeline in the drum receiving space by preventing the drum from slipping through the nozzle, while simultaneously maintaining structural integrity and attachment between the lifeline and the anchor. Consequently, during a fall in which the housing is so compromised, substantially all forces from the fall are transferred to, and carried by, the reinforcement, rather than by the housing. This allows for the housing halves or shells to be made from lightweight, non-structural materials, such as plastic, for example. The reinforcing members can be made, for example of steel, which can, for example, be ⅛" thick.

In accordance with an aspect of the retractor housing, the upper and lower reinforcements each comprise front and back members.

In accordance with an aspect of the retractor housing at least one of the housing halves defines a channel around a perimeter of the housing half; the opposed side reinforcing members being received in the channel.

In accordance with an aspect of the retractor housing the opposed side reinforcing members each include an attachment portion which extends into the attachment zone of the housing, and wherein the upper reinforcement is received in the attachment zone.

In accordance with an aspect of the retractor housing the retractable lifeline housing includes an anchor member comprising a connecting portion engaged by the upper reinforcement. The connecting portion of the anchor member can comprise a shaft with a stop mounted at opposite ends of the shaft; and wherein the upper connecting portion defines a passage through which the shaft extends. The stop is below the upper reinforcement to prevent upward axial movement of the anchor member relative to the upper reinforcement. In an embodiment, the stop defines a plate, and the anchor member further comprises an upper plate at a top of the shaft. The anchor member can include a loop or eye extending upwardly from the upper plate.

In accordance with an aspect of the housing, the housing further comprises a handle.

In accordance with an aspect of the housing, the housing further comprises an attachment point which receives an anchor member to enable the retractable to be connected to a carabiner, or the like, to mount the retractable to an anchor.

BRIEF DESCRIPTION OF THE DRAWINGS

The illustrative embodiments of the present invention are shown in the following drawings which form a part of the specification, in which.

Corresponding reference characters indicate corresponding parts throughout the several views of the drawings.

DETAILED DESCRIPTION

While the invention will be described and disclosed in connection with certain preferred embodiments, the description is not intended to limit the claimed invention to the specific embodiments shown and described herein, but rather the claimed invention is intended to cover all alternative embodiments and modifications that fall within the spirit and scope of the invention as defined by the claims included herein as well as any equivalents of the disclosed and claimed invention.

Figure 1:
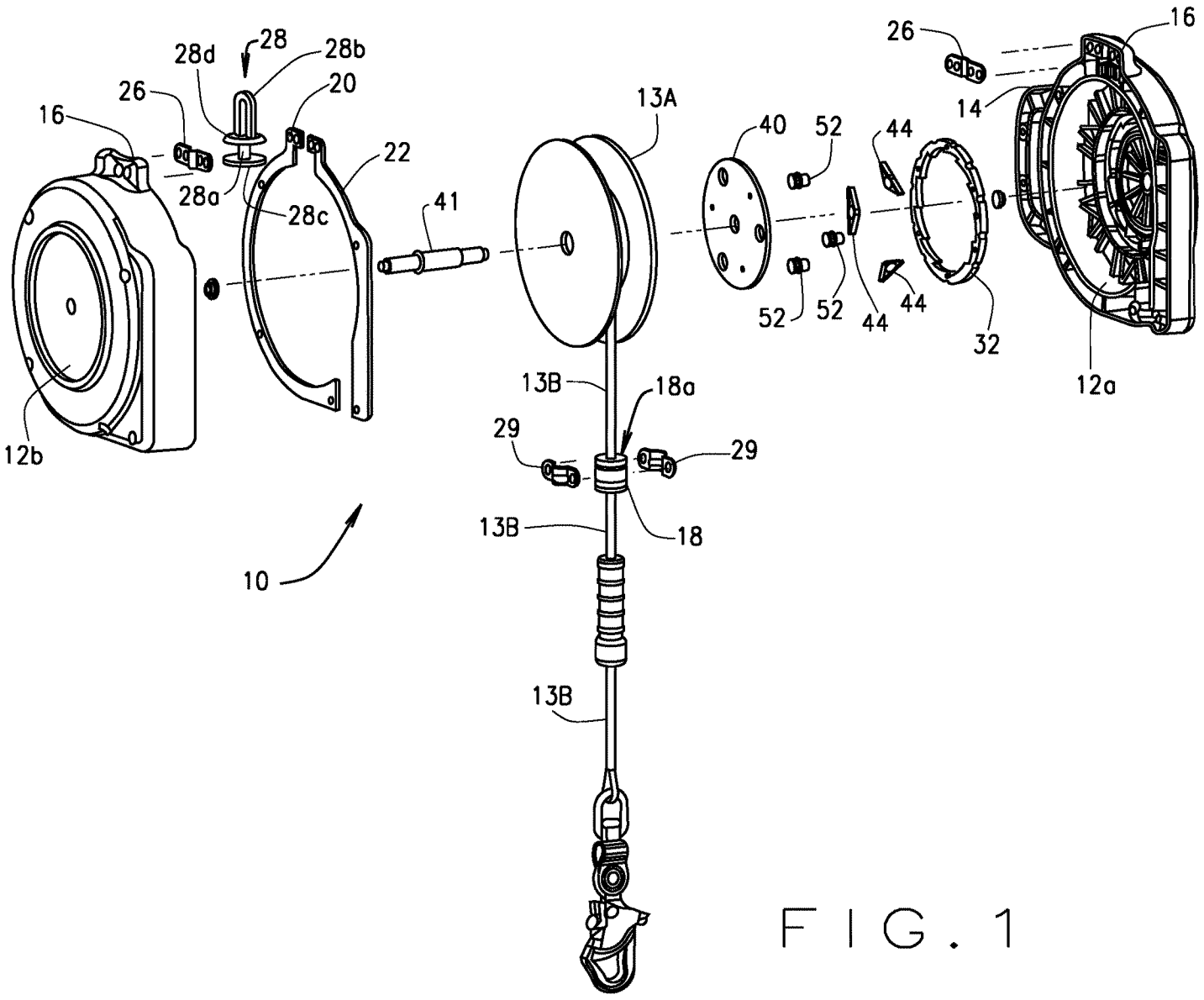
FIG. 1 is an exploded perspective view of a retractable.
Figure 2:
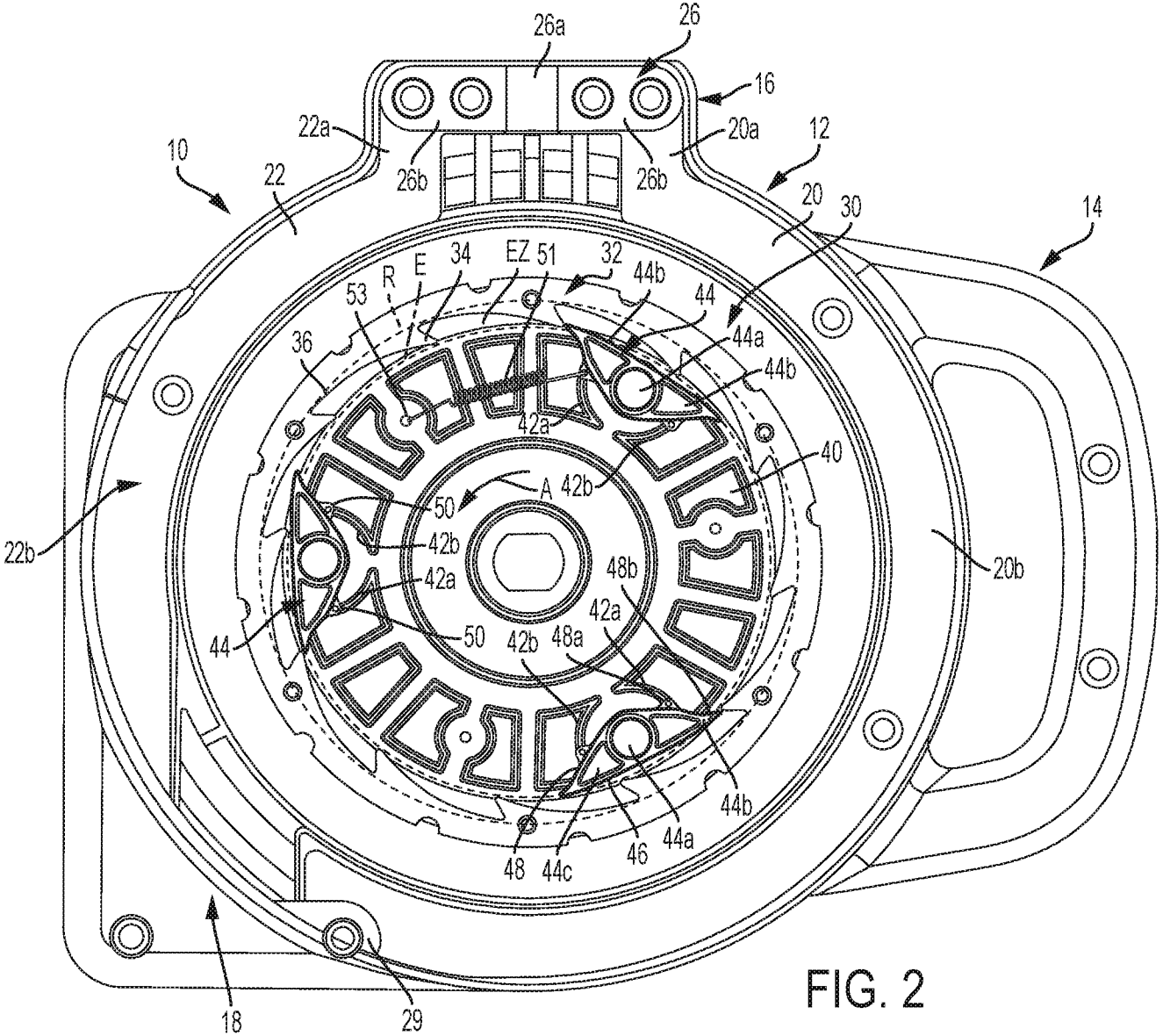
FIG. 2 is a plan view of the retractable with one housing member removed to show reinforcing members and a lock mechanism of the retractable, wherein the pawls of the lock mechanism are shown in an engagement position to lock up or prevent extension of the lifeline from the retractable.

A retractable 10, shown in FIGS. 1 and 2, has a housing 11 comprised of two housing halves or cover members 12*a,b*. The housing halves 12*a,b*, when joined, define an internal area or drum receiving space there between in which a drum 13A is rotatably mounted by an axle 41 that rotatably secures the drum 13A to the housing halves 12*a,b*. As is known a lifeline 13B is attached to and wound about the drum 13A to be extended from, and retracted onto, the drum. Only one half of the housing is visible in FIG. 2, and then from an interior view. The housing further defines a handle 14 to facilitate grasping of the retractable, an attachment point 16 which receives an anchor member 28 to enable the retractable to be connected to a carabiner, or the like, to mount the retractable to an anchor. The retractable 10 further comprises a nozzle 18 having an orifice 18*a* through which the lifeline 13B extends. As is known, the orifice 18*a* is sized to allow the lifeline 13B to extend through the nozzle 18, the drum 13A is substantially larger than the orifice 18*a*, and therefore cannot pass through the nozzle 18.

In the embodiment shown, the housing is made of a light-weight non-structural material, such as a plastic, to reduce the weight of the housing. The housing defines a channel around the perimeter of the housing which receives a handle-side reinforcing member 20 and a nozzle-side reinforcing member 22. The side reinforcing members 20, 22 each include an attachment area portion 20*a*, 22*a* and a perimeter portion 20*b*,22*b*. The attachment portions 20*a*,22*a* of the side reinforcing members each extend the height of the housing attachment point 16, and are positioned approximately 180° apart to be on opposite sides of the attachment point 16. The perimeter portions 20*b*,22*b* of the side reinforcing members extend from a bottom of their respective attachment portions 20*a*,22*a* around a portion of the perimeter of the housing to the nozzle 18. The two perimeter portions have ends that are opposite each other at the nozzle.

An upper reinforcement comprises a pair of substantially identical facing upper reinforcement members, or anchor fasteners, 26, each of which comprises a U-shaped central portion 26*a* with a pair of arms 26*b* extending from the central portion 26*a*. The two upper reinforcement members 26 face each other, such that their respective central portions are aligned and define a generally circular passage. The arms 26*b* of the reinforcement members 26 are fixed to the attachment area portions 20*a*,22*a* of the reinforcement members 20,22. The anchor member 28 for the retractable includes a shaft 28*a* which extends through the passage defined by the upper reinforcement members 26. An eye or loop 28*b* secured to the top of the shaft is sized to be connected to a carabiner or the like. As shown in FIG. 1, an upper plate 28*d* is at the top of the shaft 28*a*, and the eye or loop 28*b* extends upwardly from the plate 28*d*. The anchor member 28 further includes a stop 28*c* in the form of a lower plate at the bottom of the shaft. This stop has a dimension greater than the diameter of the passage defined by the upper reinforcing members to prevent the shaft from being withdrawn from the housing attachment point. The stop can, for example, be a bolt which is threaded onto the shaft, one or more pins which extend through the shaft, or a plate which is fixed to, or formed as part of, the shaft. Additionally, the housing includes lower reinforcing members, or nozzle fasteners, 29 which extend around the nozzle and connect the lower ends of the side reinforcing members 20,22. As can be appreciated, the reinforcing members 20, 22, 26, and 29 defines a reinforcement that extends fully around the drum receiving space between the two halves 12*a,b* of the housing. As can also be seen in FIG. 1, the cover members 12*a,b*, the upper reinforcement members 26, the lower reinforcement members 29, and the side reinforcing members 20,22, all include paired and linearly aligned orifices. As can be appreciated, a set of fasteners such as for example a set of bolts, can pass through these aligned orifices to secure together the cover members 12*a,b*, the upper and lower reinforcement members 26, 29, and the side reinforcing members 20,22. The housing, as noted above, is made from a light-weight, non-structural material, such as plastic. The reinforcing members, on the other hand, are made from a structural material, such as steel. The reinforcing members can, for example, be up to ⅛" thick. In a normal fall situation, the forces of the fall will be borne or carried by the plastic housing. However, should the housing be cracked or damaged, any forces not capable of being carried by the housing will be borne by the reinforcing members 20, 22, 26 and 29. This allows for the housing itself to be made from a light-weight, non-structural material, such as plastic without fear of catastrophic failure. In the event of a failure of the structural integrity of the plastic housing, the metal reinforcing members will prevent the lifeline 13B and drum 13A from disconnecting from the anchor member 28.

The lock mechanism 30 for the retractable is contained within a housing 12, as noted above. In this embodiment, the lock mechanism includes a stationary sperrad ring 32 positionally fixed in the housing and a rotatable pawl plate 40 having pivotable pawls 44 mounted thereon. The pawl plate with the pivotable pawls rotates in the housing relative to the sperrad ring 32. The sperrad ring 32 includes a plurality of inwardly directed teeth 34 evenly spaced about an inner edge of the sperrad ring. Twelve teeth 34 are shown, but more or fewer could be provided if desired. The teeth do not extend radially inwardly. Rather, the teeth face or point in a clock-wise direction (with reference to FIG. 2) to define a gap or pocket 36 between the tip of the teeth and the inner edge of the sperrad ring. A circle E (shown in dotted lines) defined by the tips of the teeth and a circle (shown in dotted lines) R defined by the roots of the teeth define the minimum and maximum diameters of an engagement zone EZ for the clutch lock mechanism 30.

The pawl plate 40 is operatively connected to the cable drum to rotate in the housing around an axle 41. The pawl plate is concentric with the sperrad ring 32. The pawl plate 40 is free to rotate at least in the direction of the arrow A. The pawl plate 40 has a diameter at least as large as the diameter of the circle E to enable the locking pawls 44 to be mounted near the edge E of the engagement zone EZ. In FIG. 2, the pawl plate is illustratively shown to have a diameter slightly larger than the diameter of the circle E. The pawl plate 40 defines arced slots 42*a,b* each of which have a radially outer end proximate the periphery of the pawl plate and an inner end radially inwardly of the slot outer end. The slots 42*a,b* each define an arc of a circle. The slots 42*a,b* are formed as facing pairs, with each slot 42*a* facing a slot 42*b*. The slots are spaced apart slightly at their bottoms, such that each pair of slots define two arcs of a common circle. Each slot 42*a,b* defines an arc of at least, and preferably more than, 90°, such that each slot pair, in combination, defines at least a semi-circle (that is opened at its bottom). A pawl 44 is associated with each slot pair. Three pawls 44 (and thus three slot pairs) are shown in FIG. 2, however, more or fewer pawls and slot pairs could be provided if desired. The pawls 44 are shown to be generally bat-wing shaped, with a center, or body, portion 44*a*, a leading wing 44*b* extending from one side of the body and a trailing wing 44*c* extending from the other side of the body. The leading wing 44*b* faces, or points toward, the teeth 34 and the pocket 36 of the sperrad 30, while the trailing wing 44*c* faces away from the sperrad's teeth 34. The wings 44*b,c* are generally identical, and thus generally symmetrical about a line which extends through the center of the body 44*a* from the approximate center of the inner edge to the approximate center of the outer edge of the pawl. Each wing 44*b,c* includes a substantially flat top edge 46 which extends outwardly generally from the top of the body 44*a*. Thus, the top edges of the two wings define a line that substantially defines a tangent to the round body 44*a*. Bottom edges 48 extend from essentially the bottom of the body to join the end of the top edge. The bottom edge 48 of each wing includes a first portion 48*a* of a first slope and a second portion 48*b* defining a slope shallower than the first portion slope. This gives the wings an appearance of having points at their respective ends. The pawls include a central pin 52 which extends from the center body 42*a* into a pin hole in the pawl plate. This central pin defines a pivot axis for the pawl. The pawls 44 have mounting ears 50 which protrude from the bottom edge of each wing. The mounting ears have holes which, as seen, are sized and positioned to be aligned with the slots 42*a,b*.

A spring 51 (only one spring is shown in FIG. 2) is provided for each pawl and which is positioned or configured to pull the tip of the leading wing 44*b* inwardly (away from the sperrad ring). The spring 51 extends from the ear 50 of the leading wing 44*b* to a point on the pawl plate remote from the pawl and radially inside of the connection of the spring 51 to the pawl. As shown, the spring 51 has one end received in the hole of the ear 50 of the leading wing 44*b* and a second end received in a hole 53 in the pawl plate 40 radially inwardly of the pawl ear 50. As noted, this enables the spring to pull the leading end 44*b* of the pawl radially inwardly, away from the sperrad ring, and out of the engagement zone EZ. Alternatively, the spring can be connected to the trailing wing 44*c* to bias the trailing wing outwardly toward the sperrad ring. By biasing the trailing wing toward the sperrad ring, the leading wing would be moved radially inwardly out of the engagement zone EZ due to the pivoting action of the pawl. In either event, the spring biases the pawl 44 so that the tip of the trailing wing 44*c* is in the engagement zone, and the engagement tip of the leading wing 44*b* is radially below the circle E (so as to be out of the engagement zone). The pin 52 enables the wing tips to pivot or rock into and out of the engagement zone.

The symmetry of the pawl allows for the pawl to be generally equally balanced centrifugally. Since in this embodiment, the pawl pivots about the pin 52, any imbalance would overcome the pawl spring and cause the pawl to either lock too early or too late.

Figure 2A:
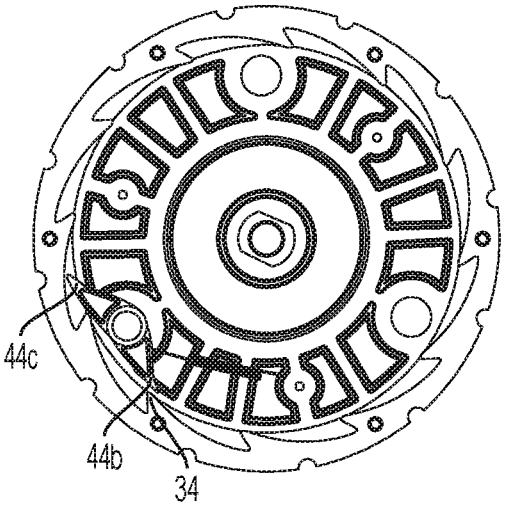
FIGS. 2A-2D are views showing a pawl plate of the locking mechanism at different rotational positions to demonstrate the pivoting of the pawl into and out of the sperrad's engagement zone.
Figure 2B:
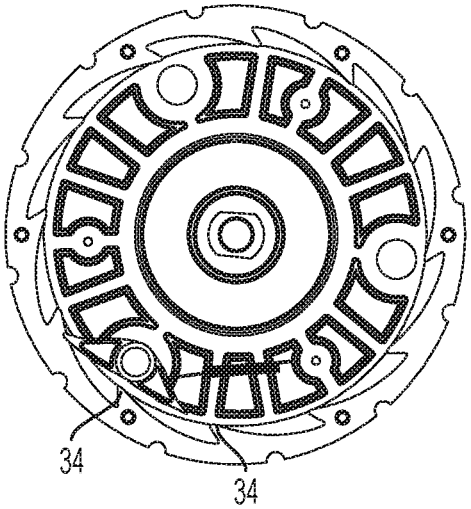
Figure 2C:
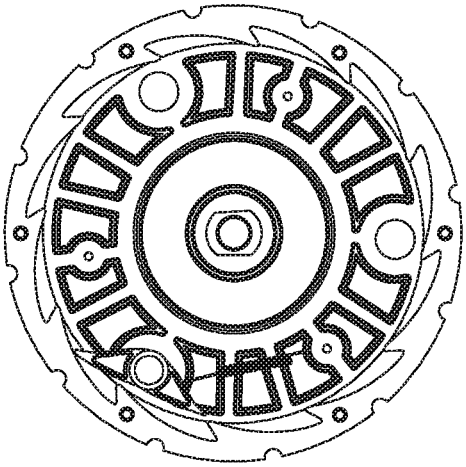
Figure 2D:
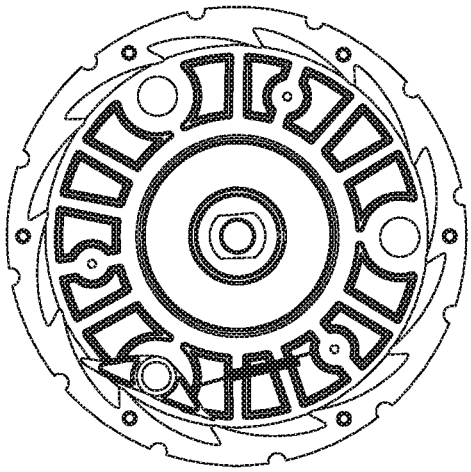

In operation, the pawl plate 40 will rotate with the drum in a direction toward the sperrad teeth 34 when the lifeline is being extended or withdrawn from the housing 12. With reference to FIG. 2, this is counterclockwise, and is shown by the arrow A. As the pawl plate rotates and as a pawl 44 passes a sperrad tooth 36, the outer edge 36 of the trailing wing 44*c* is engaged by a sperrad tooth 36 and the trailing wing 44*c* is pushed inwardly. At the same time, this action causes the tip of the leading wing 44*b* to pivot outwardly to enter the engagement zone. This operation of the locking mechanism 30 is demonstrated in FIGS. 2A-2D. In FIG. 2A, the spring 51 has pulled the leading wing 44*b* radially inwardly to place the outer edge of the trailing wing in line with a tooth on the sperrad. As the pawl plate continues to rotate (in a counterclockwise direction with reference to FIGS. 2A-D), the engagement of the outer edge of the trailing wing with the tooth causes the leading wing 44*b* to pivot radially outwardly, into the engagement zone, as seen in FIG. 2B. As the trailing edge 44*c* of the pawl passes beyond the tooth, as seen in FIG. 2C, the spring 51 will begin to act on the leading wing 44*b* to pull the leading edge out of the engagement zone.

In non-emergency situations (such as when a worker is walking and extending the lifeline), the pawl plate 40 is rotating at a speed that will allow for the spring 51 to pivot the pawl 44 to a non-engaging position wherein the tip of the leading wing is not in the engagement zone. However, during a fall, the pawl plate is rotating more quickly because the lifeline is being pulled out quickly. In this instance, the engagement tip of the leading wing 44*b* will rise up and, due to rotational momentum, dwell long enough in the engagement zone EZ to engage the pocket 36 of a sperrad tooth 34 before the spring can move the pawl 44 to the non-engaging position.

Figure 3:
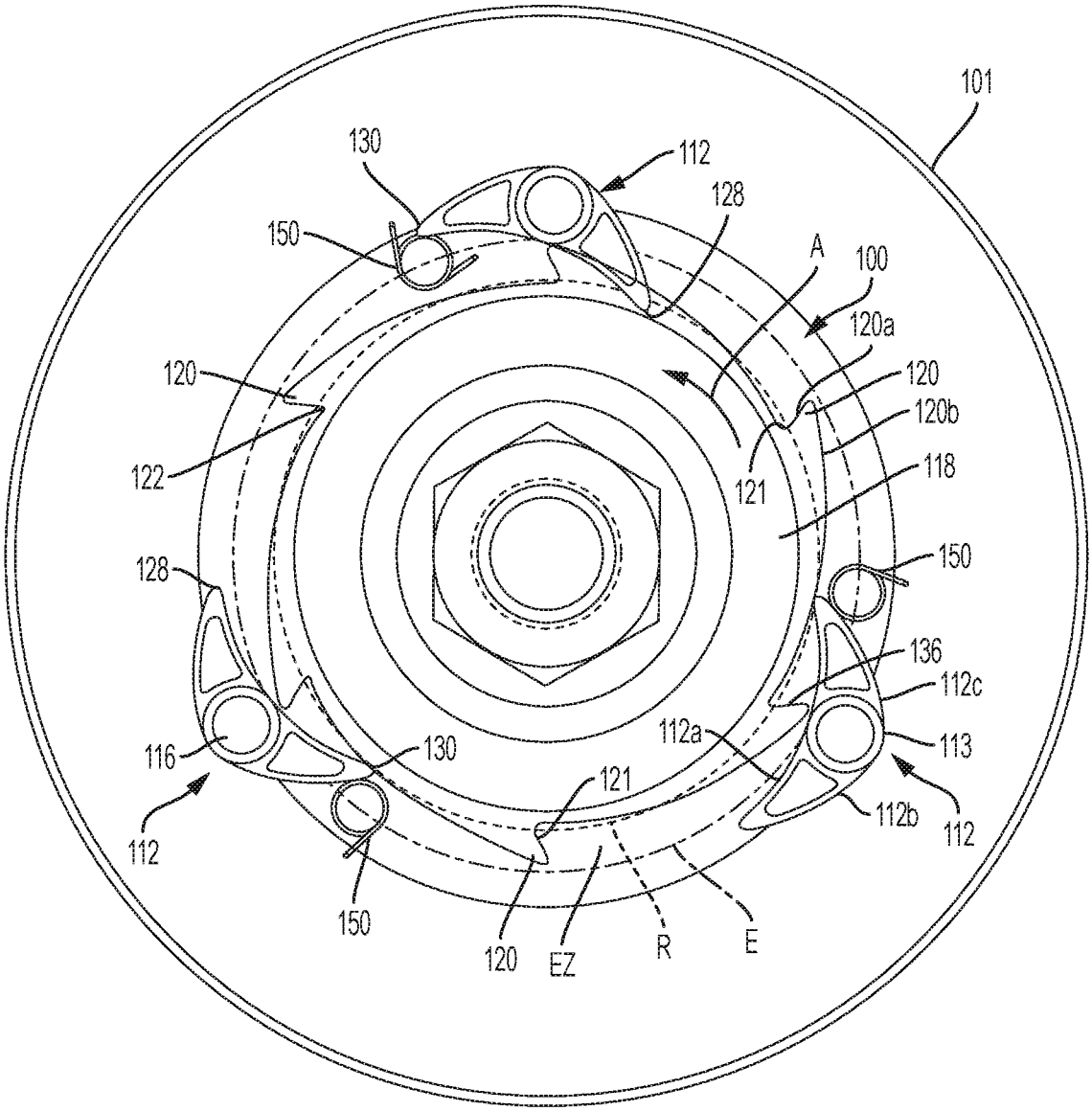
FIG. 3 is a plan view of another embodiment of a retractable lanyard locking mechanism wherein an upper pawl is illustratively pivoted to an engaging position and lower pawls are illustratively pivoted to non-engaging positions.

An alternative lock mechanism is shown in FIG. 3. In this embodiment, the pawl and pawl plate are stationary (i.e., centrifugally fixed relative to the housing) with the pawl plate being mounted to the housing or to a frame in the housing. The sperrad is operatively connected to the drum to rotate relative to the pawls with the drum. The lock mechanism 100 comprises a central sperrad 118 rotatably mounted in a retractable housing 101 to rotate at least in a direction noted by the arrow A. The sperrad 118 can, for example, be operatively connected to the drum of the retractable to rotate with the drum. The sperrad includes a plurality of teeth 120 having an inwardly sloping leading edge 120*a* and a trailing outer edge 120*b* such that the teeth define a pocket 121 and the tips of the teeth point generally in the direction of the arrow A. The teeth 120 are evenly spaced about the sperrad 118, and the sperrad is illustratively shown to have six teeth. Although more or fewer could be provided, if desired. The tips of the sperrad teeth 120 define a circle, which is slightly inside of the dotted line E; and the roots 122 of the teeth define a second circle, shown by the dotted line R. The circles E and R define the outer and inner diameters, respectively, of the sperrad tooth engagement zone EZ.

A plurality of pawls 112 are mounted in the housing 101 to pivot about a pivot axis defined by a pawl pin 116 outside of the circle E. The pawls 112 are evenly spaced about the sperrad. The clutch lock mechanism 100 is shown to have to have three pawls (i.e., one-half the number of sperrad teeth), but could have more or fewer pawls if desired. Each pawl has an inner edge 112*a*, a first side edge 112*b*, and a second side edge 112*c*. The inner edge 112*a* is convex, and the side edges 112*b,c* are both slightly convex to meet at an apex 113. Thus, the pawls are generally triangularly shaped with a radiused concave base (inner edge 112*a*) and slightly convex legs (side edges 112*b,c*). The junction of the first side edge 112*b* with the inner edge 112*a* defines a leading or engaging tip 128 of the pawl; and the junction of the second side edge 112*c* with the inner edge 112*a* defines a trailing or cam tip 130. The sides 112*b,c* are of substantially equal length, such that a triangle defined by the apex and the leading and trailing tips is substantially an isosceles triangle, and so that the apex 113 is located approximately midway between the leading and trailing tips 128, 130. The pawl is thus substantially symmetrical about a line extending through the pivot point from the approximate middle of the bottom edge 112*a* to the apex 113. This keeps the pawl centrifugally balanced so that it does not imbalance the loads on the pawl spring 150. The pawl is pivotally mounted to the pivot pin in the area between the apex 113 and the inner edge 112*a*, such that movement of one tip in one direction causes the same amount movement of the other tip in the opposite direction. Finally, the radius defined by the curvature of the inner edge 112*a* is substantially equal to the radius of the circle E. Additionally, the pawl is positioned such that a point of the inner edge 112*a* of the pawl directly below the apex 113 is substantially on the circle E, such that the center of the pawl inner edge is just slightly above the circle defined by the sperrad teeth.

The pawls 118 and the sperrad 112 are mounted in the housing to be substantially co-planar. A spring 150 is associated with each pawl 112 to urge the trailing tip 130 of the pawl into engagement with the side edge or surface of the sperrad. This allows the sperrad to not only provide an engagement tip, but also allows the sperrad to act as a cam surface to drive the pawl. The springs 150 are shown to be torsion springs, with one end connected to the housing and the other end connected to the pawl in the vicinity of the trailing tip 130. The torsion springs thus operate to positively push (rather than pull) the trailing tip 130 into engagement with the surface of the sperrad. As can be appreciated, other types of spring elements could be used. For example, compression springs, torsion springs, tension springs or leaf springs could be used. Alternatively, the springs could be replaced with a biasing element (such as an appropriately designed pad) which would operate to push the trailing end 130 of the pawl 112 into engagement with the edge of the sperrad 112.

The two lock mechanisms are each shown with three pawls, but different numbers of teeth. The number of pawls could be changed if desired. At a minimum, there must be one pawl. The maximum number of pawls, at a maximum capacity, could equal to one-half the number of sperrad teeth. Thus, the maximum number of pawls for the locking mechanism of FIG. 2 (with twelve sperrad teeth) is six, and the maximum number of pawls for the locking mechanism of FIG. 3 (with six sperrad teeth) is three. As can be seen in FIG. 2, for the cam action of the sperrad to drive the pawl motion, in an outwardly acting pawl, the pawl length is determined by, and must be at least slightly longer than, the tip distance on the sperrad teeth (i.e., the distance between the tips of adjacent sperrad teeth). For an inwardly acting pawl, such as in FIG. 3, pawl length must be less than the distance between the tips of adjacent sperrad teeth.

For all pawl mechanisms, a spring must be used to bias the pawl's trailing edge against the surface of the sperrad so that the sperrad may act as a cam to drive the displacement (pivoting) of the pawl. This spring type in most designs is a typical coiled tension spring. The tension spring is prestressed by mounting it to a screw or post that is located some distance from the pawl. The lock mechanism of FIG. 2 includes such a tension spring. When the pawl has reached its maximum rotation, the tension spring is stretched to its greatest length and puts the greatest force on the pawl to pull it out of its locked position. When the retractables are attached to rigid structural members, this creates no problem. However, if the retractable is attached to a flexible crossbeam that can see significant flex under impact loads, this can create a condition in which the beam will cause the retractable to bound, and in so doing, causes the load to release, enabling the pawl to unlock and drop the load until another lockup occurs. In other words, a ratcheting effect can be created in which the retractable locks, unlocks, and relocks slowly inching lifeline cable out of the unit until all the cable is extracted. While this condition is not generally harmful to the worker, repeated locking, unlocking, falling and relocking could be dangerous, or even fatal, if the worker is positioned over water or moving traffic.

For this reason, an improved spring method is used on the retractable of FIG. 3. In the retractable of FIG. 3, a torsional (push) spring is used rather than a traditional tension (pull) spring. By using a spring that pushes, it can be mounted so that when the pawl is at full extension, the spring is in an almost neutral position. This means that when the pawl locks up, it dwells in that position during a rebound, so that a rebound condition does not cause it to unlock, thus preventing ratcheting.

Because the spring 150 biases the trailing end 130 of the pawl against the edge of the sperrad 118, the inner edge 112*a* of the pawls face generally towards the sperrad teeth 120 (as can be seen with the bottom two pawls in FIG. 3). Thus, as the sperrad 118 rotates in the direction A (with the rotation of the drum), the sperrad teeth 120 will engage the inner edge 112*a* of the pawl (as seen in the bottom two pawls in FIG. 14). As the sperrad 118 continues to rotate, the sperrad teeth 120 will push against the inner edge 112*a* of the pawl, causing the pawl 112 to pivot about its pawl pin 116. This will push the cam end 130 away from the circle E and cause the engagement tip 128 to enter the engagement zone EZ between the circles E and R. The top pawl in FIG. 3 is shown in this engaged position. As the sperrad tooth 120 passes beyond the pawl 112, the spring 150 will force the cam end 130 of the pawl against the edge of the sperrad, bringing the engagement tip 128 of the pawl out of the engagement zone EZ.

Figure 3A:
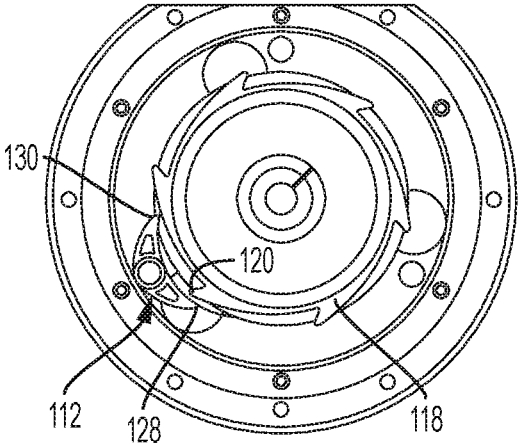
FIGS. 3A-3D are views showing the sperrad of the locking mechanism of FIG. 3 at different rotational positions to demonstrate the pivoting of the pawl into and out of the sperrad's engagement zone.
Figure 3B:
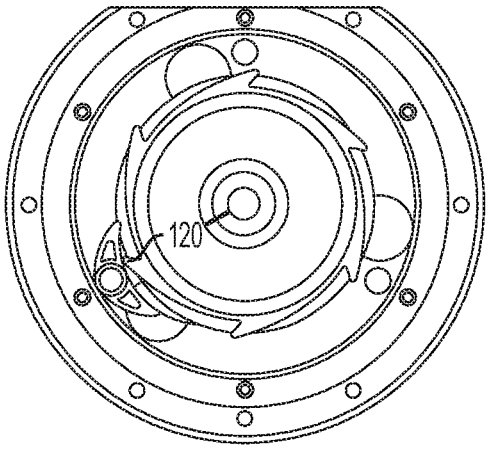
Figure 3C:
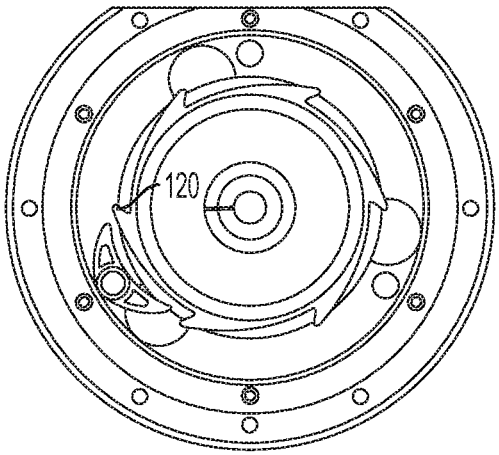
Figure 3D:
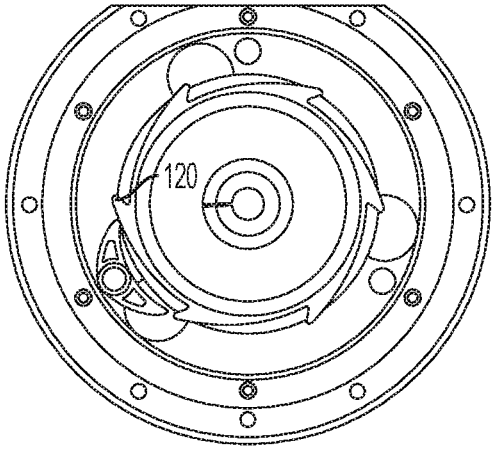

This operation of the locking mechanism 100 is demonstrated in FIGS. 3A-3D. In FIG. 3A, the shown pawl is pivoted by the spring to a position in which its trailing tip 130 is adjacent, or in contact with, the trailing edge of a sperrad tooth, and the leading tip 128 is raised out of the engagement zone. As the sperrad rotates (clockwise with reference to FIGS. 3A-D), a sperrad tooth 120 passes under the leading tip 128 of the pawl (as shown in FIG. 3A) to engage the inner edge of the pawl (as shown in FIG. 3B). The contact of the sperrad tooth with the curved inner edge of the pawl causes the pawl to pivot about its pin, such that the leading tip 128 enters the engagement zone (as shown in FIG. 3C). In this manner, the sperrad tooth acts as a cam to move or pivot the pawl. As the sperrad continues to rotate, the tooth will pass under the trailing tip 130, at which point the spring will urge the trailing tip of the pawl back towards the sperrad edge (as seen in FIG. 3D).

As with the locking mechanism 30 (FIGS. 2-2D), under normal (non-emergency) operation, the rotation of the sperrad 118 is relatively slow, the position and strength of the spring 150, the size (tip-to-tip width) of the pawl 112, and the length of the trailing edge of each tooth 120 is selected such that the spring 150 will pivot the engagement tip 128 of the pawl out of the engagement zone EZ before the oncoming sperrad tooth 120 engages pawl engagement tip 128. However, during a fall, the rate of rotation of the sperrad 118 exceeds the rate at which the spring 150 pushes against the pawl, and the pocket 121 of at least one sperrad tooth 120 will engage the engagement or leading tip 128 of at least one of the pawls 112.

In both lock mechanisms 30 and 100, the size (strength) of the spring, the width of the pawl and the distance between on tooth tip (or root) and the preceding tooth tip (or root) are selected such that during normal (non-emergency) operation, the spring can pivot the engaging end of the pawl out of the engagement zone before a sperrad tooth engages the pawl engagement tip. Further, because the pawl is pivoted into the engagement zone by its engagement with the sperrad, the locking mechanisms 30, 100 positively moves the pawl engagement tip via a camming action into the engagement zone EZ of the sperrad. The locking mechanisms thus do not need to rely upon centrifugal forces to urge the pawl engagement tip into the engagement zone, as occurs with many currently available clutch lock mechanisms. Additionally, should the pawl become locked-up or otherwise frozen in position, operation of the lanyard will be prevented, and the user will know that the lanyard should not be used. This is especially true if the pawl is locked in the engagement position of the top pawl in FIG. 3.

The pawls 44, 112 of the lock mechanisms 30, 100 are symmetrical about an axis extending through their pivot axes from their bottom edges to their top edges. Thus, the opposite ends of the pawls are substantially identical in three dimensions (i.e., width, length, and height), and thus have substantially similar weights. This substantial identically (or mirror image-ness) of the opposed wings of the pawls substantially reduces, if not eliminates, the impact of any centrifugal forces upon the pawls. Thus, the lock mechanisms 30, 100 do not rely upon centrifugal forces to move the engagement tips of the pawls into the engagement zone. Rather, the contact or interaction between the sperrad (or sperrad ring) and the pawls substantially ensures that the engagement tip of the pawl is in the engagement zone, to substantially ensure that a sperrad tooth will engage the engagement tip of a pawl (or vice versa) to stop rotation of the retractable during a fall.

While we have described in the detailed description multiple configurations that may be encompassed within the disclosed embodiments of this invention, numerous other alternative configurations, that would now be apparent to one of ordinary skill in the art, may be designed and constructed within the bounds of our invention as set forth in the claims.

For example, the sperrad teeth need not be shaped as shown, but may be any variety of differing shapes so long as they properly interact with the engagement tips of the pawls. Still further, the clutch lock mechanism need not have exactly three pawls, but may have a single pawl or many more than three, again, so long as the pawls enable the clutch lock mechanism to operate as described herein. Also, the sperrad is not restricted to having a set of exactly six teeth at uniform intervals, nor that the teeth must all be of uniform shape and size and uniformly oriented in the same rotational direction. Rather, there may be more or less than six teeth on the sperrad 18, and the teeth 20 may be of varying sizes and shapes, so long as they properly operate as part of the clutch lock mechanism as outlined in this disclosure. In fact, the sperrad ring 32 (FIG. 2) has twelve teeth. The provision of more teeth provides more opportunities of the engagement tip of one of the pawls to engage a sperrad tooth to stop unwinding of the lifeline during a fall.

Additional variations or modifications to the configuration of the clutch lock mechanism of the present invention, may occur to those skilled in the art upon reviewing the subject matter of this invention. Such variations, if within the spirit of this disclosure, are intended to be encompassed within the scope of this invention. The description of the embodiments as set forth herein, and as shown in the drawings, is provided for illustrative purposes only and, unless otherwise expressly set forth, is not intended to limit the scope of the claims, which set forth the metes and bounds of my invention.

What is claimed is:

1. A housing for a retractable lifeline assembly; said assembly comprising an anchor member and a nozzle having an orifice through which a lifeline can extend and retract; said housing comprising a first cover member and a second cover member, said anchor member being mounted at least in part in said housing one or more of said first and second cover members holding said anchor member, said first and second cover members defining a drum receiving space therebetween for rotatably receiving a drum lifeline wound thereon; said lifeline extending through said nozzle orifice; said drum being larger than said nozzle orifice; said housing further comprising an internal reinforcement positioned in substantial part between said first and second cover members; said internal reinforcement comprising at least one side reinforcing member, an anchor fastener at one end of said side reinforcing member for fastening said anchor member to said reinforcement, and a nozzle fastener at a second end of said side reinforcing member for fastening said nozzle to said reinforcement; said internal reinforcement extending at least in part around said drum receiving space from said nozzle fastener to said anchor fastener to establish a structural connection between the anchor member and the nozzle through the internal reinforcement, said nozzle fastener structurally securing the nozzle to the internal reinforcement; said side reinforcement member being made from a structural material, whereby, upon a separation of the anchor member from the housing during a fall, said internal reinforcement will provide a structural connection between the anchor member and one of said cable and said drum such that substantially all forces from the fall are transferred to, and carried by, said internal reinforcement.

2. The retractable lifeline housing of claim 1, wherein said housing is made from a non-structural, lightweight material.

3. The retractable lifeline housing of claim 2, wherein said housing is made from a plastic.

4. The retractable lifeline housing of claim 1, wherein said anchor member further includes a shaft and a stop at a bottom of said shaft sized to prevent said shaft from being pulled from said housing.

5. The retractable lifeline housing of claim 1, wherein said anchor member comprises a connecting portion, said connecting portion engaging the upper end of said internal reinforcement.

6. The retractable lifeline housing of claim 5, wherein said connecting portion of said anchor member comprises a shaft with a stop mounted at opposite ends of said shaft; and wherein said anchor fastener defines a passage through which said shaft extends, said stop being below said passage to prevent upward axial movement of said anchor member relative to said internal reinforcement.

7. The retractable lifeline housing of claim 6, wherein said stop comprises a plate; said anchor member further comprising an upper plate at a top of said shaft.

8. The retractable lifeline housing of claim 7, wherein said anchor member further includes a loop or eye extending upwardly from said upper plate.

9. The retractable lifeline housing of claim 1, wherein said internal reinforcement is made of steel.

10. The retractable lifeline housing of claim 9, wherein said steel of said reinforcement members is up to ⅛" thick.

11. The retractable lifeline housing of claim 1, further comprising a handle.

12. The retractable lifeline housing of claim 1, wherein said anchor member comprises an attachment point configured to enable the retractable to be connected to an anchor fastener to mount the retractable to an anchor.

13. The retractable lifeline housing of claim 1, wherein said internal reinforcement comprises a first member and a second member, each of said first and second members surrounding in part the drum receiving space, said first and second members being structurally secured to each other.

14. The retractable lifeline housing of claim 1, wherein said nozzle comprises an outwardly directed protrusion, said nozzle fastener comprises a detent that receives said protrusion when the nozzle engages the nozzle fastener to fasten the nozzle to the internal reinforcement.

15. The retractable lifeline housing of claim 14, wherein said nozzle protrusion comprises a circumferential ring extending from said nozzle.

16. The retractable lifeline housing of claim 14, wherein said nozzle fastener detent comprises a radial trough.

17. The retractable lifeline housing of claim 1, wherein one of said anchor fastener and said nozzle fastener comprises a clamp.

18. The retractable lifeline housing of claim 1, wherein said internal reinforcement comprises two substantially flat members, each of said internal reinforcement members positioned at least in part around said drum.

* * * * *